US007157637B2

(12) United States Patent
Petrella, Jr.

(10) Patent No.: US 7,157,637 B2
(45) Date of Patent: Jan. 2, 2007

(54) TAMBOURINE

(76) Inventor: Nicholas Petrella, Jr., 809 Castle Pine Ct., Pontiac, MI (US) 48340

( * ) Notice: Subject to any disclaimer, the term of this patent is extended or adjusted under 35 U.S.C. 154(b) by 226 days.

(21) Appl. No.: 10/895,296

(22) Filed: Jul. 20, 2004

(65) Prior Publication Data

US 2006/0016320 A1 Jan. 26, 2006

(51) Int. Cl.
*G10D 13/02* (2006.01)

(52) U.S. Cl. ..... 84/418; 84/419

(58) Field of Classification Search ..... 84/418–420, 84/402, 410; D17/22

See application file for complete search history.

(56) References Cited

U.S. PATENT DOCUMENTS

| | | | | |
|---|---|---|---|---|
| 4,269,105 A | | 5/1981 | Salmon | |
| 4,843,944 A | | 7/1989 | Shimoda | |
| 5,040,446 A | | 8/1991 | Cohen et al. | |
| 5,284,079 A | | 2/1994 | Wang | |
| D354,301 S | | 1/1995 | Sahley | |
| 5,377,575 A | | 1/1995 | Huth, III | |
| 6,127,614 A | * | 10/2000 | Lombardi | 84/418 |
| 6,156,960 A | * | 12/2000 | Abrams | 84/269 |
| D446,238 S | | 8/2001 | Grey | |
| 6,362,406 B1 | | 3/2002 | Enhoffer et al. | |
| 6,620,991 B1 | | 9/2003 | Honiball | |

* cited by examiner

*Primary Examiner*—Gary F. Paumen
(74) *Attorney, Agent, or Firm*—Harness, Dickey & Pierce, P.L.C.

(57) ABSTRACT

The present application is directed to a percussion musical instrument such as a tambourine, riq, pandiero and the like having non-rectangular windows within which the jingles are supported. The configuration of the window affords a greater range of pitch motion for the jingles than otherwise afforded in similar conventional instruments. As such, the pitch motion of the jingles may equal or exceed the range of roll motion of the jingles. In another aspect, the present invention is directed to an instrument having an ovoid shaped shell to provide distinct rotational moments of inertia along a major axis and a minor axis.

19 Claims, 3 Drawing Sheets

TAMBOURINE

FIELD OF THE INVENTION

The present invention relates to percussion musical instruments and more particularly to tambourine-like instruments having an improved means for supporting the jingles within the shell to enhance the tone quality of the musical tones produced by the tambourine.

BACKGROUND OF THE INVENTION

Tambourines, riqs, pandieros and the like are types of percussion musical instruments known as ideophones capable of producing a variety of sounds. In their simplest form, these instruments include a frame or shell with a series of windows formed therein and paired sets of jingles that are supported for movement within the window. A percussive sound is produced by hitting, shaking, or otherwise vibrating the frame so as to move the jingles within the window. In some embodiments, the instrument may further include a stretch membrane disposed over an end of the shell. This membrane can be used as a means for vibrating the jingles or alternately producing tones by means of beating or otherwise vibrating the stretched membrane.

The quality of the sound produced by the tambourine is dependent upon the jingles ability to resonate once they have been excited. More specifically, the musical tones generated by collision of the metallic jingles is enhanced when the jingle is allowed to resonate and ring. However, the manner in which the jingles are idly supported within current tambourine designs inhibits their ability to so resonate. Specifically, the windows within which the jingles are supported are generally rectangular while the thickness of the shell is relatively thin. Accordingly, the jingles are allowed to rotate about an axis generally tangential to the shell (roll) substantially freely but are not allowed to rotate about an axis generally normal to the shell (pitch) in an equally freely manner. As such, the jingles are overly constrained in a pitch direction resulting in an overly damped or poor acoustic quality.

Accordingly, there is a need in the art to provide a tambourine which affords a free rotational movement along both a roll axis and a pitch axis for generating an improved percussive sound with rich tonal qualities.

SUMMARY OF THE INVENTION

Accordingly, the present invention is directed to a tambourine of the type having a frame with a window formed through a sidewall thereof. The window is configured in a non-rectangular shape when viewed normal to the sidewall such that a medial region of the window has a height that is less than a lateral region of the window defined on either side of the medial region. A pair of jingles are supported on a post which extends through the medial region of the window. With the window so configured, the jingles are afforded a range of pitch motion which is defined generally normal to the shell which is not less than the range of the roll motion defined generally tangential to the shell.

In another aspect, the present invention is directed to a tambourine including a frame having a sidewall with a window formed therethrough. A pair of jingles idly supported on a post extending through the window. A roll stop formed on the frame adjacent the window defines range of roll motion for the jingles supported therein. Likewise, a pitch stop formed on the frame adjacent the window defines a range of pitch motion which is generally perpendicular to the range of roll motion. The pitch stop and roll stops are configured such that the range of pitch is not less than the range of roll motion.

In yet another aspect, the present invention provides a tambourine having an ovoid shell. The shell further includes a handgrip portion provided thereon in a location a minor axis of the ovid intersects the shell. In this way, the jingles supported within the shell which are away from or distal relative to the handgrip portion are readily excited through relatively minor movement of the handgrip portion.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 5:
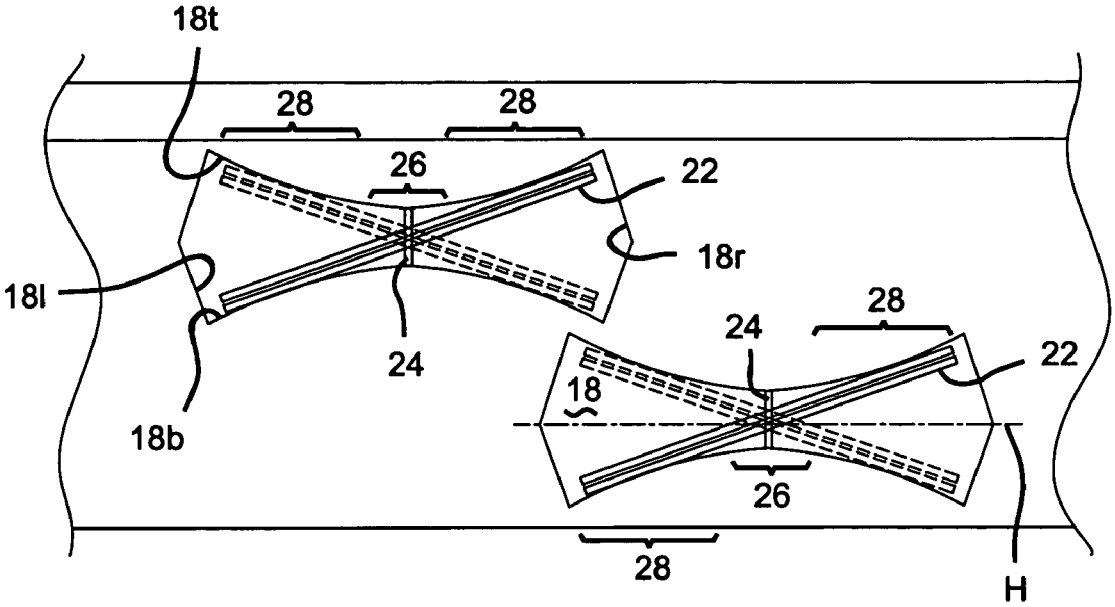
FIG. 5 is a detailed view of the tambourine illustrating a presently preferred configuration of the non-rectangular window.

With reference now to the figures, the present invention is directed to a tambourine 10 of the type generally having a frame 12 defining an interior sidewall 14 and an exterior sidewall 16 (as best seen in FIG. 5). The frame 12 is typically made of wood; however, other suitable materials such as plastic, composite, laminate, etc. may be used. The shell 12 has a series of windows 18 formed therethrough. In accordance with the illustrated embodiment the windows 18 are divided into two groups—an upper row of ten windows and a lower row of nine windows. Generally, the windows 18 are disposed equal angularly around the perimeter of the shell. A portion 20 of the shell 12 is devoid of any windows and defines a handgrip portion 20 for the tambourine 10. The handgrip 20 may include a suitably sized hole (not shown) form therethrough for supporting the tambourine 10 on a stand or other support structure.

The tambourine 10 further includes a pair of jingles 22 idly supported within each window 18 on a post 24. Specifically, post 24 extends through a medial region 26 of window 18. Jingles 22 have an aperture which receives post 24 to loosely constrain the jingles 22 within window 18. In this regard, jingles 22 have an oversize aperture relative to post 24 for allowing generally free gimbaled movement (i.e., rotation about all three axes—roll, pitch and yaw) thereon.

The present invention includes a window configuration for enhancing the tonal qualities of the tambourine by providing a non-rectangular window design which enables relatively unconstrained rotational movement of the jingles through a range of motion, thereby enhancing the tonal qualities of the tambourine 10. With specific reference to FIGS. 5 and 6, a preferred embodiment of the non-rectangular window 18 is illustrated. Window 18 is defined by a top surface 18*t*, a bottom surface 18*b*, and left and right side services 18*l*, 18*r*. Furthermore, the window 18 can be divided into a medial region 26 centrally located within the window and a pair of lateral regions 28 located outboard of the medial region 26. The non-rectangular configuration of window 18 is such that the top surface 18*t* diverges relative to the bottom surface 18*b* in a direction outboard from medial region 26. In this way the medial region 26 of the window 18 is narrower than the lateral regions 28 so as to take on a generally bowtie-like shape. The left and right side surfaces 18*l*, 18*r* interconnect the top and bottom surfaces 18*t*, 18*b*.

As illustrated, the window 18 shows a top and bottom surface 18*t*, 18*l* which have a generally curvilinear configuration and which each diverge from horizontal axis H of the window. Thus, the window 18 has a non-rectangular shape when viewed normal to the sidewall 16 of the shell 12 such that the medial region 26 has a height which is less than the lateral regions 28 of the window 18. The pair of jingles 22 are idly supported within window 18 to enable a greater range of pitch motion (i.e., rotational of the jingles about an axis normal to the drawing in FIG. 5) than would otherwise be afforded for a generally rectangular window.

Figure 6:
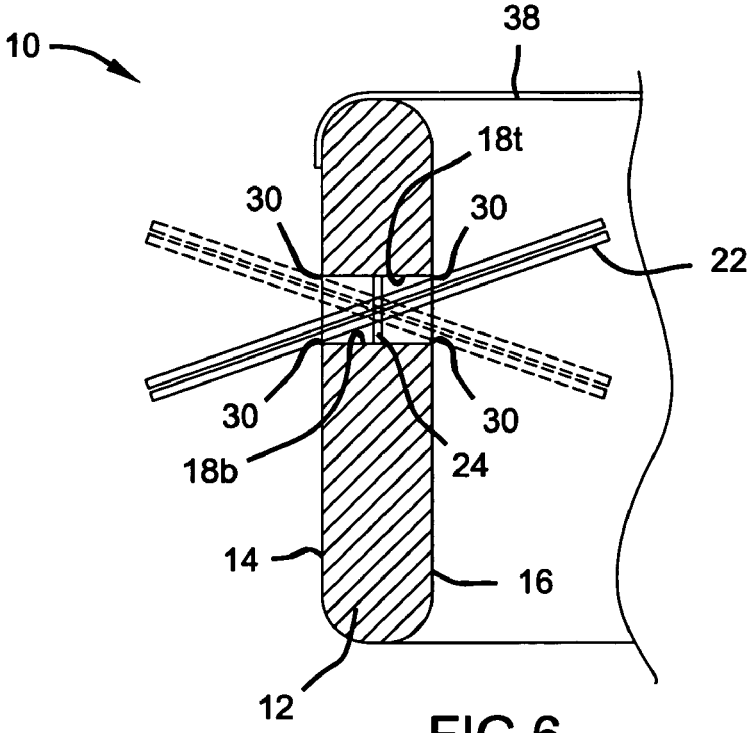
FIG. 6 is a cross-sectional view taken through the medial region of a window.

In further detail, a portion of the shell 12 adjacent the window opening 18 defines the stops or limits for the range of pitch motion and range of roll motion. Specifically, as seen in FIG. 5, the top surface 18*t* and the bottom surface 18*b* of the window 18 form stops or limits on the range of pitch motion for the jingles 22. Likewise, the edges 30 formed at the intersection between the outer and inner surfaces 14, 16 of shell 12 with the top and bottom surfaces 18*t*, 18*b* of the window 18 provide roll stops or limits that define the range of roll motion for the jingles 22 within the window 18 as best seen in FIG. 6. From a comparison of FIG. 5 and FIG. 6 it will be appreciated that the non-rectangular shape of window 18 affords a noticeably larger range of pitch motion for the jingle which may equal or exceed the range of roll motion.

Figure 1:
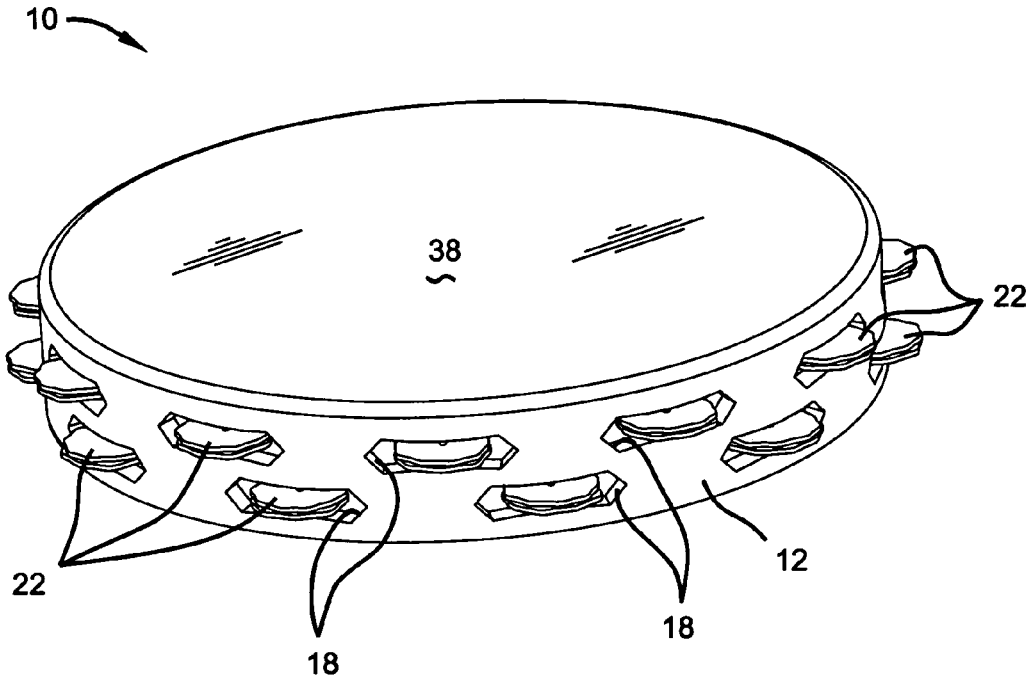
FIG. 1 is a non-perspective view of a tambourine in accordance with the present invention.
Figure 2:
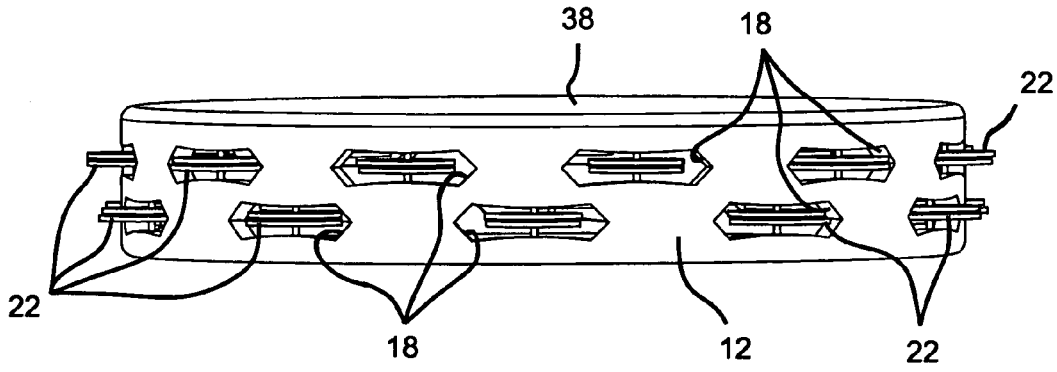
FIG. 2 is a side view of the tambourine showing FIG. 1.
Figure 3:
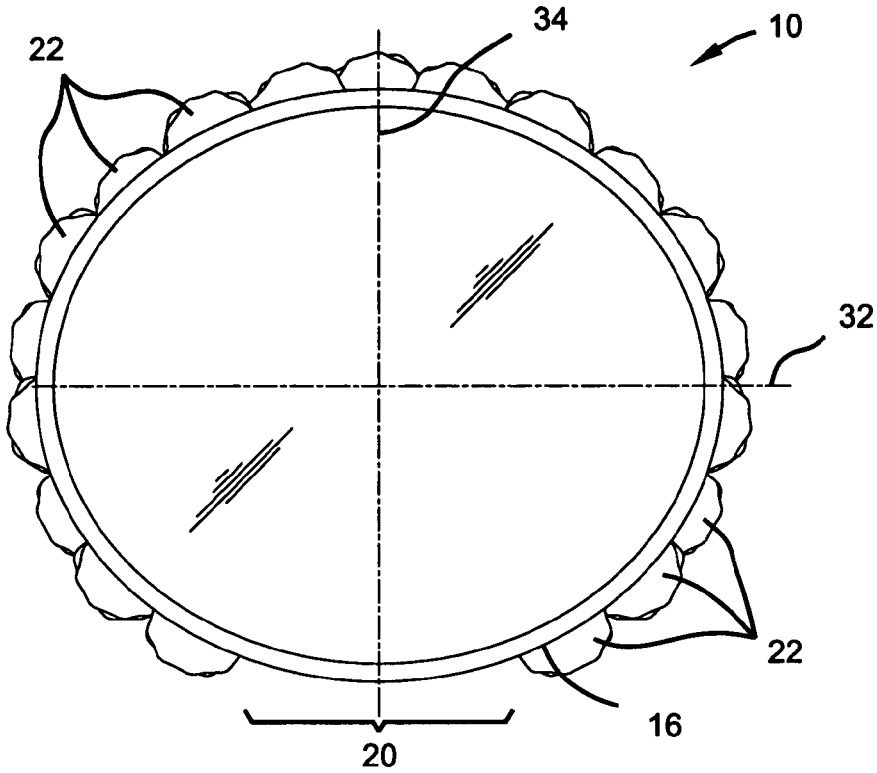
FIG. 3 is a top-plan view of the tambourine illustrated in FIG. 1.
Figure 4:
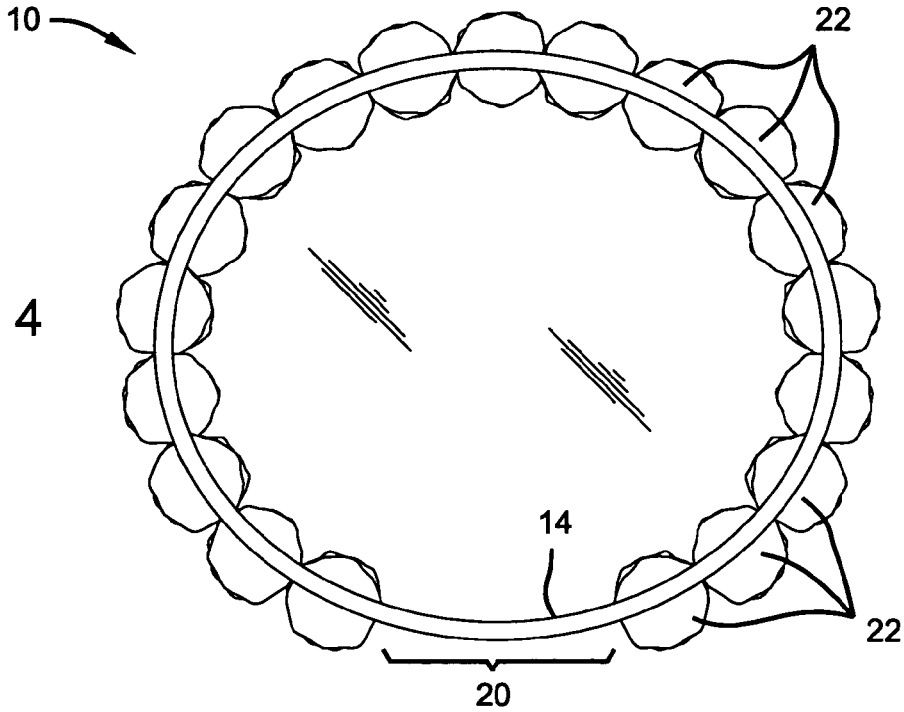
FIG. 4 is a bottom-plan view of the tambourine shell in FIG. 1.

In another aspect of the present invention, tambourine 10 has a shell 12 which is ovoid in shape as best seen in FIGS. 3 and 4. As particularly preferred, the shell 12 is symmetrical ellipse having a dimension along the major axis 32 which is greater than the dimension along the minor axis 34. The handgrip portion of shell 12 is located along the minor axis of 34. In this manner, the ovid shape of shell 12 increases the rotational inertia for the jingles located approximate the major axis 32. As such, these jingles may be excited more readily due to the increased rotational movement of inertia associated with this shape. As presently preferred, the dimension along the minor axis is approximately 90 percent of the dimension along the major axis.

As is generally known in the art, a tambourine 12 may also be provided with a stretch membrane 36 over an edge 38 of the shell 12. The membrane 38 is secured to the shell by an adhesive or other suitably means. In this way, the membrane may be utilized for additional means of exciting the jingles or alternatively as a membranophone.

While the present invention has been described with reference to various preferred embodiments, one skilled in the art will appreciate that various modification which do not depart from the gist of the invention are intended to be within the scope of the invention. In this manner, the shape and configuration of the window may be modified from the bowtie-shaped window illustrated in the drawings yet provide the functions and benefits described herein. Likewise, the elliptical shape of the shell may also be modified to provide for other geometric or irregular shapes which provide distinct rotational moments of inertia along a major and minor axis. These variations as well as others as contemplated by the present invention are not to be regarded as a departure from the spirit and scope thereof.

What is claimed is:

1. In a percussion instrument of the type having a frame with a window formed through a sidewall thereof, a post supported by said frame and extending through a medial region of said window and a pair of jingles supported on said post within said window, the improvement comprising said window having a non-rectangular shape when viewed normal to said sidewall such that said medial region of said window has a height which is less than a lateral region of said window defined on either side of said medial region.

2. The percussion instrument of claim 1 wherein said frame comprises an ovoid shell.

3. The percussion instrument of claim 2 wherein said ovoid shell comprises an elliptical shell having a hand grip region provided thereon where a minor axis of said elliptical shell intersects said frame.

4. The percussion instrument of claim 1 wherein said non-rectangular shape comprises a bow-tie shape.

5. The percussion instrument of claim 1 wherein said frame has a plurality of non-rectangular windows formed therethrough, each of said windows having a post supported by said frame and extending through a medial region of said window and a pair of jingles supported on said post within said window.

6. The percussion instrument of claim 1 wherein said frame comprises a shell having a membrane disposed over an end of said shell.

7. A tambourine comprising:

a frame having a sidewall with an inner surface, an outer surface and a window opening formed therethrough which diverges from a medial region of said window to a lateral region of said window when viewed normal to said sidewall, a post supported by said frame and extending through a medial region of said window;

a pair of jingles supported on said post within said window opening;

a roll stop on said frame adjacent said window opening, said stop defining a range of roll motion for said pair of jingles within said window opening; and a pitch stop on said frame adjacent said window opening generally perpendicular to said roll stop, said stop defining a range of pitch motion for said pair of jingles within said window opening.

8. The tambourine of claim 7 wherein said roll stop comprises:

a first roll stop formed on said frame at an upper boundary of said window opening; and a second roll stop formed on said frame at a lower edge of said window opening.

9. The tambourine of claim 7 wherein said pitch stop comprises:

a first pitch stop formed on an inner edge of said frame where said window opening passes through said inner surface of said sidewall; and a second pitch stop formed on an outer edge of said frame where said window opening passes through said outer surface of said sidewall.

10. The tambourine of claim 7 wherein said range of pitch motion is not less than said range of roll motion.

11. The tambourine of claim 7 wherein said window opening comprises a bow-tie shaped window opening.

12. The tambourine of claim 7 wherein said frame comprises an ovoid shell.

13. The tambourine of claim 12 wherein said ovoid shell comprises an elliptical shell having a hand grip region provided thereon where a minor axis of said elliptical shell intersects said frame.

14. The tambourine of claim 7 further comprising:

a plurality of window openings formed through said sidewall, each of said window opening diverging from a medial region to a lateral region thereof;

a post supported by said frame and extending through a medial region of each of said plurality of said window openings;

a pair of jingles supported on said post within each of said plurality of window openings;

a roll stop on said frame adjacent said each of said plurality of window openings, said roll stop defining a range of roll motion for said pair of jingles within said window openings; and a pitch stop on said frame adjacent each of said plurality of window generally perpendicular to said roll stop, said pitch stop defining a range of pitch motion for said pair of jingles within said window opening.

15. The tambourine of claim 7 wherein said frame comprises a shell having a membrane disposed over an end of said shell.

16. A tambourine comprising:

an ovoid shell having an inner surface, an outer surface and a bow-tie shaped window formed therethrough;

a post supported by said ovoid shell and extending through a medial region of said bow-tie shaped window;

a pair of jingles supported on said post within said bow-tie shaped window;

a set of roll stops including a first roll stop formed on said ovoid shell at an upper boundary of said window and a second roll stop formed on said ovoid shell at a lower boundary of said window, said set of roll stops defining a roll range of motion for said pair of jingles within said bow-tie shaped window; and a set of pitch stops including a first pitch stop formed on an inner edge of said ovoid shell where said window passes through said inner surface of said sidewall and a second pitch stop formed on an outer edge of said ovoid shell where said window passes through said outer surface of said sidewall, said set of pitch stops defining a pitch range of motion for said pair of jingles within said bow-tie shaped window.

17. The tambourine of claim 16 wherein said ovoid shell comprises an elliptical shell having a hand grip region provided thereon where a minor axis of said elliptical shell intersects said frame.

18. The tambourine of claim 16 wherein said frame comprises a shell having a membrane disposed over an end of said shell.

19. The tambourine of claim 16 further comprising:

a plurality of windows formed through said sidewall;

a post supported by said frame and extending through a medial region of each of said plurality of said windows;

a pair of jingles supported on said post within each of said plurality of windows;

a set of roll stops on said ovoid shell adjacent said each of said plurality of windows, said set of roll stops defining a roll range of motion for said pair of jingles within said window; and a set of pitch stops on said frame adjacent each of said plurality of windows generally perpendicular to said roll stop, said set of pitch stops defining a pitch range of motion for said pair of jingles within said window, wherein said pitch range of motion is not less than said roll range of motion.

* * * * *